219-121 SR
10/13/81 XR 4,294,631

United States Patent [19]
Anthony et al.
[11] 4,294,631
[45] Oct. 13, 1981

[54] SURFACE CORROSION INHIBITION OF ZIRCONIUM ALLOYS BY LASER SURFACE β-QUENCHING

[75] Inventors: Thomas R. Anthony, Schenectady, N.Y.; Harvey E. Cline, Stanford, Calif.

[73] Assignee: General Electric Company, Schenectady, N.Y.

[21] Appl. No.: 972,389

[22] Filed: Dec. 22, 1978

[51] Int. Cl.³ ..... C22F 1/18; B23K 26/00
[52] U.S. Cl. ..... 148/133; 219/121 LM
[58] Field of Search ..... 148/4, 133, 11.5 F, 148/32, 32.5, 39, 31; 75/177; 427/35, 53.1; 250/49.5; 219/121 L, 121 LM

[56] References Cited

U.S. PATENT DOCUMENTS

| | | | |
|---|---|---|---|
| 2,968,723 | 1/1961 | Steigerwald | 250/49.5 |
| 3,231,430 | 1/1966 | Krieger et al. | 148/4 |
| 3,294,594 | 12/1966 | Bertea et al. | 75/177 |
| 3,865,635 | 2/1975 | Hofvenstam et al. | 148/11.5 F |

OTHER PUBLICATIONS

"Surface Hardening and Alloying with a Laser Beam System", *Industrial Heating*, Jul. 1974, pp. 19–25.

*Primary Examiner*—Peter K. Skiff
*Attorney, Agent, or Firm*—Stephen S. Strunck; James C. Davis, Jr.; Leo I. MaLossi

[57] ABSTRACT

A laser beam is scanned over the surface of a structure comprising zirconium alloy in overlapping passes to form a barrier layer of corrosion resistant β-quenched zirconium alloy at the treated surface.

9 Claims, 3 Drawing Figures

SURFACE CORROSION INHIBITION OF ZIRCONIUM ALLOYS BY LASER SURFACE β-QUENCHING

FIELD OF THE INVENTION

This invention relates to β-quenched corrosion-inhibited surfaces of bulk zirconium alloys and a process for making the same.

DESCRIPTION OF PRIOR ART

Zirconium alloys are now widely accepted as cladding and structural materials in water-cooled, moderated boiling water and pressurized water nuclear reactors. These alloys combine a low neutron absorbtion cross-section with a good corrosion resistance and adequate mechanical properties.

The most common zirconium alloys used up to now are Zircaloy-2 and Zircaloy-4. The nominal composition of these alloys are given in Table I.

TABLE I

| Zircaloy-2 | Element | Weight % |
|---|---|---|
| | Sn | 1.2–1.7 |
| | Fe | 0.07–0.20 |
| | Cr | 0.05–0.15 |
| | Ni | 0.03–0.08 |
| | Zr | Balance |
| **Zircaloy-4** | **Element** | **Weight %** |
| | Sn | 1.2–1.7 |
| | Fe | 0.18–0.24 |
| | Cr | 0.07–0.13 |
| | Zr | Balance |

In addition to Zircaloy-2 and Zircaloy-4, considerable work has been done on Zr-15%Nb alloys.

In general, these materials have proved adequate under nuclear reactor operating conditions. The fuel-element design engineer would like a cladding material that is more resistant to high temperature aqueous corrosion while maintaining an adequate mechanical strength.

During manufacture of Zircaloy channels, a seam in the channels is welded together. It has been observed that this seam weld is substantially more resistant to accelerated nodular corrosion than the rest of the unwelded channel. In addition, other work in the literature has shown that an accelerated nodular corrosion in a high temperature, high pressure steam environment can be inhibited by β-phase heat treatments which are similar to the effect derived when the weld seams cool down through the β-phase region immediately after welding.

The exact reason for the enhanced resistance of β-quenched Zircaloy to accelerated nodular corrosion in a high temperature, high pressure steam environment is not understood completely. It appears, however, that this enhanced corrosion resistance is related to the fine grain, equiaxed structure and to the fine dispersion of iron, nickel and chromium intermetallics in β-quenched Zircaloy. The effect of β-quenching on the metallurgical structure of Zircaloy stems from the fact that β is the high temperature phase of Zircaloy that is not stable below 810° C. and the fact that iron, nickel and chromium are β-stabilizers that partition preferentially to the β-phase. Referring now to FIG. 1, if a Zircaloy sample is held in the $\alpha+\beta$ phase region that ranges between 810° C. to 970° C., the Zircaloy transforms to a two phase mixture of $\alpha+\beta$ grains. Iron, nickel and chrome being β-stabilizers will segregate to the β phase grains. On cooling the Zircaloy from this two phase region back through the $\alpha+\beta\rightarrow\alpha$ phase boundary into the α region, the β phase decomposes precipitating fine grains of α-zirconium and rejecting the iron, nickel and chrome intermetallics on the adjacent grain boundaries of the newly formed α grains. The resulting metallurgical structure of the Zircaloy is thus a fine grained α structure with a fine dispersion of iron, nickel and chromium intermetallics distributed therein. A similar metallurgical structure can be achieved by quenching directly from the β-phase region above 970° C. This heat treatment results in a very fine grain α "basket weave" structure with a fine distribution of iron, nickel and chromium intermetallics dispersed therein. This latter heat treatment parallels the thermal history of a weld on cooling and results in a metallurgical structure with enhanced resistance to accelerated nodular corrosion in high pressure, high temperature steam. Not only do the Zircaloys but also Zr-15%Nb exhibits this corrosion resistance in the β-quenched condition.

Such a β-quench or $\alpha+\beta$ quench is not always feasible for bulk Zircaloy pieces because forming operations, mechanical property requirements, and the generation of large thermal stress or large thermal distortions in a bulk Zircaloy body may prevent such a quenching operation. In such cases, other ways must be found to prevent the accelerated nodular corrosion of Zircaloy that occurs in steam at high pressures and temperatures.

Enhanced corrosion of Zircaloy-2 and Zircaloy-4 has been observed under boiling water nuclear reactor conditions and appears to initiate at localized spots and spreads across the Zircaloy surface by lateral growth such that in the initial stages of growth these thick light-colored oxide nodules appear like islands on a thin homogeneous dark oxide background. This accelerated corrosion process that occurs in high-temperature, high-pressure steam can be inhibited metallurgically by quenching Zircaloy from its high temperature body centered cubic β form. β-quenched Zircaloy tends to form a thin coherent protective oxide in a high temperature (500° C.) and a high pressure (100 atm) steam environment, that is substantially more resistant to in-reactor corrosion than Zircaloy that has not been inhibited by a β-phase heat treatment.

Unfortunately, a β-phase heat treatment reduces the mechanical strength of Zircaloy and markedly increases the strain rate at which strain rate sensitivities indicative of superplasticity are observed. This high strain rate sensitivity and lower strength is caused by grain boundary sliding on increased grain boundary area due to a finer grain size in β-quenched Zircaloy. Because of these mechanical deficiencies, bulk β-quenched Zircaloy is therefore not particularly desirable for cladding and structural materials for water-cooled nuclear reactors.

Despite the potential detrimental effect of β-quenching on the mechanical properties of Zircaloy, bulk β-quenching of Zircalloy channels for nuclear reactors has been commercialized because of the superior corrosion resistance of β-quenched Zircaloy. This commercial process consists of passing a Zircaloy channel through an induction heater to heat the channel into the two-phase, $\alpha+\beta$, region. The channel is subsequently rapidly quenched by spraying water on the hot channel. Although this induction-heating-water-spray process imparts the desired corrosion resistant properties to the Zircaloy channel, it suffers from several deficiencies.

First, the exposure of the Zircaloy channel to oxygen and water during the induction heating and water quenching allows a thick black oxide to form on the channel that subsequently must be removed. This removal step adds to the manufacturing cost of the channel.

Secondly, although it is only necessary to heat treat the surface layers of the channel, the current commercial process exposes the entire channel bulk to the heat treatment required only by the surface layers. The resulting change in mechanical properties of the channel under long term creep conditions may not be desirable.

Thirdly, the water-spray quench is a generally messy process to carry out in a plant where the control of humidity and cleanliness are important.

It is therefore desirable to have a new type of $\beta$-quenched Zircaloy that can be used in circumstances where bulk $\beta$-quenched Zircaloy can not either be used or formed, where a thick black oxide is not formed on the surface of the Zircaloy and where all fluid quenching mediums are eliminated.

An object of this invention is to provide a new and improved method for surface $\beta$-quenching Zircaloy to provide a structure which overcomes the deficiencies of the prior art.

Another object of this invention is to provide a new and improved method for $\beta$-quenching the surfaces of a large body of Zircaloy without changing the metallurgical structure and the mechanical strength of the bulk, or core, of the Zircaloy body.

Another object of this invention is to provide a new and improved method for $\beta$-quenching the surface of a body of Zircaloy without utilizing any quenching fluids, liquids or gases.

Another object of this invention is to provide a new and improved method for $\beta$-quenching the surface of a body of Zircaloy during which no thick oxide is formed on the Zircaloy body during the process.

Another object of this invention is to provide a new and improved method for $\beta$-quenching the surfaces of a large body of Zircaloy without generating large thermal stresses that would cause distortion of the body.

Other objects of this invention will, in part, be obvious and will, in part, appear hereafter.

BRIEF DESCRIPTION OF THE INVENTION

In accordance with the teachings of this invention, there is provided a method of $\beta$-quenching the surface of a body of zirconium alloy material. The method of $\beta$-quenching improves the corrosion resistance of the body upon exposure to high pressure and high temperature steam.

The surface portion of the body is heated to a temperature range where body centered cubic $\beta$ grains of the Zircaloy material are formed. The heated surface portion is continued to be isothermally heated in the elevated temperature range for a sufficient time to assume the nucleation and growth of the $\beta$ grains. The heated surface region is then rapidly quenched to form a surface region of $\beta$-quenched Zircaloy material encompassing and integral with a core of Zircaloy material. The metallurgical microstructure of the $\beta$-quenched integral outer surface region is a fine-grain, basket weave $\alpha$ grain structure with a uniform distribution therein of fine transition metal intermetallic materials wherein the transition metal is at least one selected from the group consisting of iron, nickel, chromium, vanadium and tantalum. The microstructure of the core material is selected to maximize the physical structure and mechanical properties of the body of zirconium alloy material. The metallurgical microstructure of the core comprises $\alpha$ grains larger in size than the $\alpha$ grains of the integral outer surface region and a distribution of fine transition metal intermetallics which are less uniformly distributed therein than in the integral outer surface region.

A preferred method of forming the $\beta$-quenched integral outer surface region is by employing a laser beam in a series of overlapping passes. Either the laser may be movable in an XY translation, or the body of zirconium alloy material may be translated in an XY direction.

DESCRIPTION OF THE INVENTION

We have discovered that by scanning a laser beam over the surface of a body of Zircaloy, a thin layer contiguous to the surface is first heated to a temperature where the $\beta$phase is formed and then rapidly self-quenched, forming a barrier of $\beta$-quenched Zircaloy at the surface.

Figure 1:
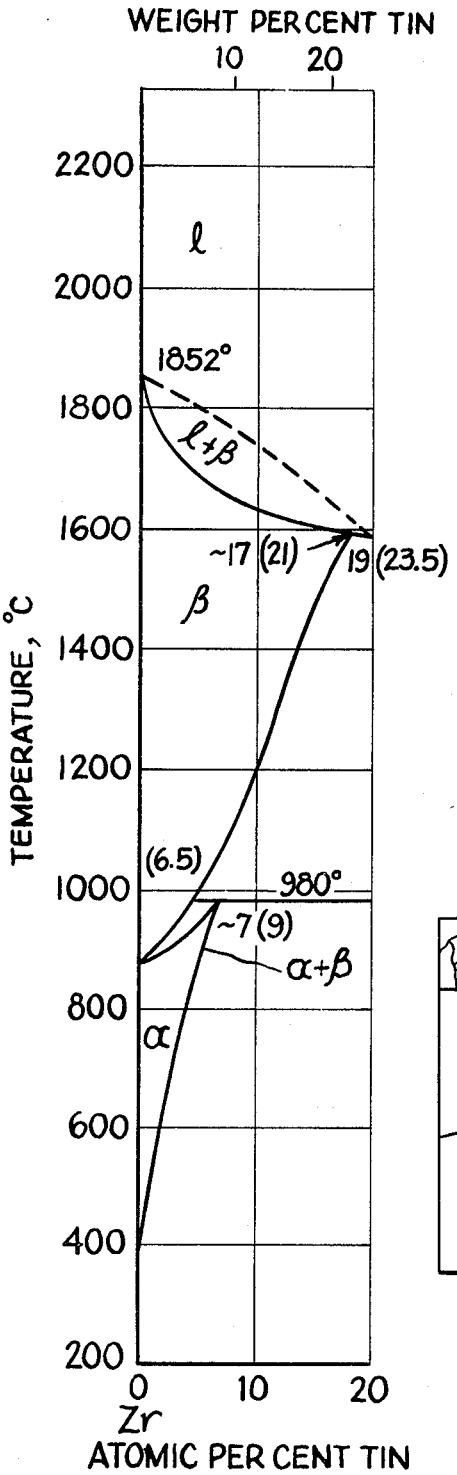
FIG. 1 is the equilibrium phase diagram of zirconium and tin. Tin is the major alloy addition to zirconium that produces Zircaloy. In the range of interest from 1.2 to 1.7 wt%Sn, Zircaloy has three phases in the temperature range indicated, namely, the hexagonal close-packed $\alpha$ phase, the body-centered cubic $\beta$ phase and the liquid l phase.
Figure 2:
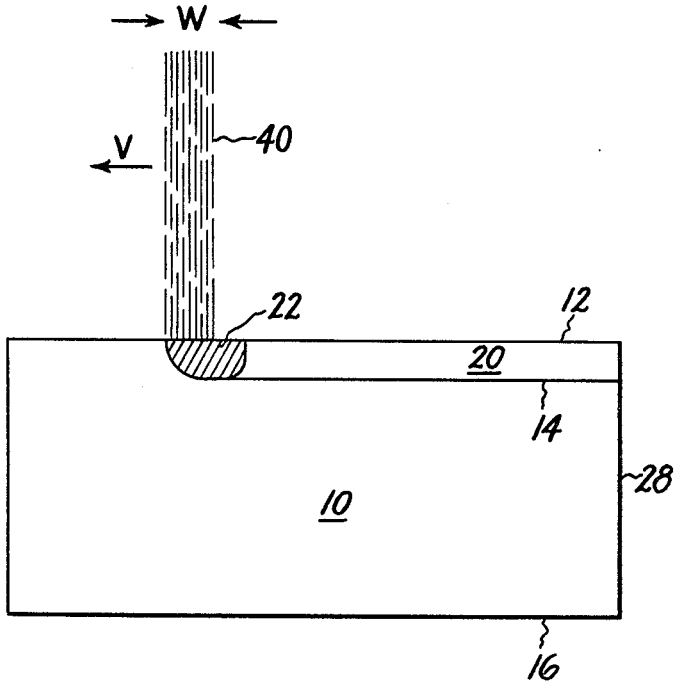
FIG. 2 is a schematic illustration of laser processing of a Zircaloy slab.

Referring now to FIG. 2, there is shown a slab-like body 10 of Zircaloy undergoing laser $\beta$-quenching. A laser beam 40 impinges on the surface 12 of the Zircaloy body 10 forming a region 22 that is heated into the temperature range where $\beta$ grains of Zircaloy nucleate and grow. The laser beam scans across the surface 12 of body 10 with a velocity V. Immediately behind the moving heated region 22 of body 10, the Zircaloy self-quenches forming a path 20 of $\beta$-quenched Zircaloy across the surface 12 of the Zircaloy body 10.

The power of the laser beam 40 is sufficient at the given laser beam scan rate V to form a region 22 of predetermined depth that is heated into the temperature range where $\beta$ grains form. The $\beta$-quenched material 20 in the surface of layer 12 of body 10 resists accelerated nodular corrosion in a high pressure, high temperature steam environment.

In order for the heated surface region 22 to form $\beta$-grains, sufficient time must elapse at high temperatures for $\beta$ grain nucleation and growth to take place. If $\delta$ is the radius of the heated zone 22 beneath the laser beam 40 moving at a velocity V, then the time $\tau$ that the surface layer is heated is, $$\tau = 2\delta/V \qquad (1)$$

The time required for the nucleation of $\beta$ grains $\tau_N$ and the time $\tau_G$ required for the growth of these $\beta$ grains to a size L at the grain growth velocity $V_G$ is $$\tau_{total} = \tau_N + \tau_G = \tau_N + L/V_G \quad (2)$$

From Equations (1) and (2) and the condition that $\tau > \tau_{total}$ the maximum laser-scan velocity $V_{max}$ with which $\beta$-quenching will still occur is $$V_{max} \leqq \frac{2V_G\delta}{[(V_G\tau_N) + L]} \quad (3)$$

Taking values of $V_G = 2\times10^{-3}$ cm/sec, $\delta = 2$ cm, $L = 10^{-4}$ cm and $\tau_N = 10^{-1}$ sec gives the maximum laser-scan velocity capable of $\beta$-quenching the surface layer of Zircaloy of 26 cm/sec for the 2 cm size of heated zone 22. L, $V_G$ and $\tau_N$ are intrinsic properties of the Zircaloy material and can not be varied. However, the size $\delta$ of the heated zone 22 can be varied at will by varying the width W of the laser beam 40. By varying the width W of the laser beam 40, the maximum laser-scan rate $V_{max}$ of the laser can also be varied.

As shown above, a maximum critical laser-scan velocity exists above which there will not be time for $\beta$ grains to form in the heated zone 22. In addition, there is a minimum critical laser-scan velocity $V_{min}$ below which the desired metallurgical structure of Zircaloy will not form because of too slow a cooling rate. The physical cause of the maximum laser velocity limit was the time required in the heated zone for $\beta$ grain nucleation and growth. On the other hand, the physical cause of the minimum laser velocity limit is the minimum quench rate required to form the $\beta$-quenched metallurgical structure of Zircaloy that is resistant to accelerated nodular corrosion in a high pressure and high temperature steam environment.

The quench rate $\partial T/\partial t$ of Zircaloy in the surface zone 20 behind the moving laser beam 40 is given by $$\partial T/\partial t = \overline{V}\cdot\overline{\nabla T} \quad (4)$$

where $\overline{VT}$ is the temperature gradient in the Zircaloy. If the laser beam is moving in the X direction, by dimensional analysis, the time-averaged temperature gradient dT/dx at a point in the specimen with temperature T is, $$dT/dX = (V_x/D_T)T$$

where $V_x$ is the laser velocity, T is the temperature and $D_T$ is the thermal diffusion constant of Zircaloy. The combination of equations (4) and (5) can be solved for the minimum critical laser scan velocity $V_{min}$ that will give the minimum required quench rate $(-\partial T/\partial t)_{min}$ $$V_{min} \geqq [(2D_T/T_B)(-\partial T/\partial t)_{min}]^{\frac{1}{2}}$$

where $T_B$ is the temperature at the $\alpha$ to $\alpha+\beta$ phase boundary in Zircaloy. Substituting the values of $T_B = 810°$ C., $D_T = 0.6$ cm$^2$/sec, and $(-\partial T/\partial t)_{min} = 15°$ C./sec, the minimum laser-scan velocity $V_{min}$ for $\beta$-quenching Zircaloy is $1.4\times10^{-1}$ cm/sec. This value compares with a maximum permissible laser-scan velocity of 26 cm/sec required to form the $\beta$ grams beneath the laser beam. Thus there is only a two order-of-magnitude range in laser-scanning rates which are compatible with surface $\beta$-quenching Zircaloy by laser surface heating in order to make the Zircaloy resistant to accelerated modular corrosion in a high pressure and high temperature steam environment.

Figure 3:
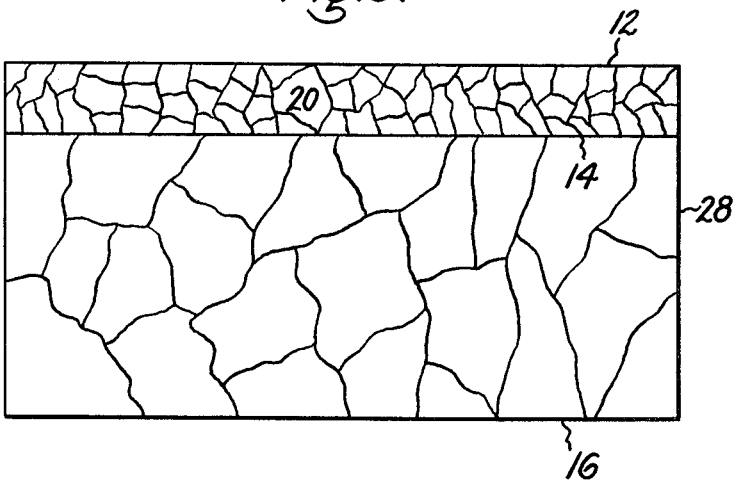
FIG. 3 is a schematic illustration of a laser processed Zircaloy slab showing the surface heated and $\beta$-quenched region with the contiguous unheated $\alpha$ region below.

Referring now to FIG. 3, a body of Zircaloy 10 with top and bottom surfaces 12 and 16 respectively and side faces 28 is shown after laser surface $\beta$-quenching. Zone 20 of Zircaloy body 10 is a "basket weave" fine grained $\alpha$-Zircaloy containing a very fine dispersion of intermetallics of iron, nickel and chromium resulting from surface $\beta$-quenching. The bulk of body 10 is left in its original metallurgical condition with its larger $\alpha$-grains and less finely distributed dispersion of intermetallics. The metallurgical structure of the bulk of body 10 has been chosen by those skilled in the art to provide the best mechanical and structural properties for its ultimate use in a reactor. The $\beta$-quenched surface region 20, on the other hand, has been formed principally to resist accelerated nodular corrosion in a high pressure and high temperature steam environment. The composite structure consisting of the $\beta$-quenched surface region 20 and the Zircaloy bulk presents a metallurgical structure with excellent mechanical, structured and corrosion-resistant properties.

We claim as our invention:

1. A method for improving the corrosion resistance of a body of a zirconium alloy to high pressure and high temperature steam including the process steps of (a) heating substantially isothermally, without melting, by means of a scanning laser beam a surface region of said body to a temperature range for a sufficient period of time to assure nucleation and growth of the body centered cubic $\beta$ grains of said zirconium alloy material; and (b) quenching said heated surface region at a rate effective to form thereby a metallurgical microstructure in said surface region consisting of $\beta$-quenched zirconium alloy material, said surface region encompassing thereby a core of zirconium alloy material, said core having a metallurgical structure selected to maximize the physical and mechanical properties of the body.

2. The method of claim 1 wherein said heating of said surface region extends to a predetermined depth forming thereby a heated zone, said laser beam being scanned in a series of passes continuously over said surface region of said body.

3. The method of claim 2 wherein scanning of said surface region by said laser beam is performed at a velocity within the range defined by:

$$V_{max} \leqq \frac{2\delta V_G}{\{(V_G\tau_N) + L\}}$$

wherein $\delta$ is the radius of said heated zone, $V_G$ is the $\beta$ grain growth velocity, $\tau_N$ is the nucleation time for the $\beta$ phase, and L is the $\beta$ grain size; and $$V_{min} \geqq [(2D_T/T_B)(-\partial T/\partial t)_{min}]^{\frac{1}{2}}$$

wherein $D_T$ is the thermal diffusion constant of the zirconium alloy being $\beta$-quenched, $T_B$ is the temperature of the $\alpha$ to $\alpha+\beta$ phase boundary in the zirconium alloy, and $(-\partial T/\partial t)_{min}$ is the minimum quench rate that allows the formation of the $\beta$-quenched metallurgical microstructure of the zirconium alloy.

4. The method of claim 2 wherein said heating of said surface region is performed by holding said body of said zirconium alloy stationary and moving said laser beam in an XY direction to effect thereby said scanning of said laser beam.

5. The method of claim 2 including the additional process step of arranging said series of passes to be mutually adjacent passes and overlapping said mutually adjacent passes a predetermined amount to insure complete treatment of said surface region by laser scanning.

6. The method of claim 1 wherein said zirconium alloy is Zircaloy-2 having the following composition by element and weight percent

| | |
|---|---|
| Sn | 1.2–1.7 |
| Fe | 0.07–0.20 |
| Cr | 0.05–0.15 |
| Ni | 0.03–0.08 |
| Zr | Balance |

7. The method of claim 1 wherein said zirconium alloy is Zircaloy-4 having the following composition by element and weight percent

| | |
|---|---|
| Sn | 1.2–1.7 |
| Fe | 0.18–0.24 |
| Cr | 0.07–0.13 |
| Zr | Balance |

8. The method of claim 1 wherein said zirconium alloy has the following composition by element and weight percent

| | |
|---|---|
| Nb | 15 |
| X | 0–1 |
| Zr | Balance |

wherein

X is a transition metal selected from the group consisting of Fe, Ni, Cr, V and Ta.

9. The method of claim 2 wherein said heating of said surface region is performed by holding said laser beam stationary, and moving said body of said zirconium alloy beneath said laser beam in an XY direction to effect thereby said scanning of said laser beam.

* * * * *